US009567040B2

(12) United States Patent
Tahar

(10) Patent No.: US 9,567,040 B2
(45) Date of Patent: Feb. 14, 2017

(54) TENSION-LEG PLATFORM ANCHORING SYSTEM

(71) Applicant: Arcandra Tahar, Houston, TX (US)

(72) Inventor: Arcandra Tahar, Houston, TX (US)

( * ) Notice: Subject to any disclaimer, the term of this patent is extended or adjusted under 35 U.S.C. 154(b) by 0 days.

(21) Appl. No.: 14/853,898

(22) Filed: Sep. 14, 2015

(65) Prior Publication Data

US 2016/0075410 A1 Mar. 17, 2016

Related U.S. Application Data

(60) Provisional application No. 62/049,410, filed on Sep. 12, 2014.

(51) Int. Cl.
*B63B 21/50* (2006.01)

(52) U.S. Cl.
CPC ..... *B63B 21/502* (2013.01)

(58) Field of Classification Search
CPC ..... B63B 21/502
USPC ..... 405/223.1, 224; 114/264–266
See application file for complete search history.

(56) References Cited

U.S. PATENT DOCUMENTS

H001246 H * 11/1993 Huffaker ..... B63B 21/502 114/264
2002/0176747 A1* 11/2002 Hanna ..... B63B 21/502 405/224
2003/0031517 A1* 2/2003 Wetch ..... B63B 35/4413 405/205

* cited by examiner

*Primary Examiner* — Sunil Singh

(57) ABSTRACT

A tension-leg platform anchoring system is used to tether the columns of a floating platform to the seabed and restrict movement of the entire platform. The tension-leg platform anchoring system includes a topside and a plurality of anchored floating supports. The topside provides a deck for supporting workers and equipment. The anchored floating supports are used to keep the topside afloat and limit movement. The anchored floating support includes a column, at least one mooring assembly, and an anchor. The column is connected to the topside and is used to keep the tension-leg platform afloat. The mooring assembly includes a column coupler, a first tendon, and an anchor coupler, which are used together to tether the column to the anchor. The column coupler is tethered to the anchor coupler through the first tendon, which is connected to the column by the column coupler.

7 Claims, 17 Drawing Sheets

DETAIL A

DETAIL B

DETAIL c

DETAIL D1

DETAIL D2

DETAIL E

DETAIL F

DETAIL G

DETAIL H

TENSION-LEG PLATFORM ANCHORING SYSTEM

The current application claims a priority to the U.S. Provisional Patent application Ser. No. 62/049,410 filed on Sep. 12, 2014. The current application is filed on Sep. 14, 2015 while Sep. 12, 2015 was on a weekend.

FIELD OF THE INVENTION

The present invention relates generally to floating offshore structures. More specifically, the present invention is a buoyant semi-submersible offshore platform which uses tendons made from cables or chains instead of steel pipes to moor the structure to the seabed, thus restricting the movement of the present invention on the water.

BACKGROUND OF THE INVENTION

Offshore platforms, used for oil and natural gas production and a number of other utilities are often susceptible to wind, wave, and current forces. As a result, such platforms must overcome such forces in order to maintain a relatively fixed position. It is important that the floating structure remain stable throughout its operation so that it is safe for people to work on the structure and so that the structure can function properly. Traditional catenary moorings typically consist of freely hanging lines that connect a floating structure to anchors, or piles, on the seabed, positioned at some distance from the floating structure. Steel-linked chain and wire rope have conventionally been used. These lines form a catenary shape and rely on an increase or decrease in line tension as the lines lift off or settle on the seafloor. This is needed to produce a restoring force as the surface platform is displaced by the environment. Because the restoring force provided by the traditional mooring system is generally small, the floating platform experiences all six degree of freedom motions.

Another type of mooring system uses tendons and is typically used in Tension-Leg Platforms (TLP). The mooring system is made up of a set of tension legs, or tendons, which attach to the platform and connect to a template or foundation on the seafloor. The foundation is held in place by piles either driven or sucked into the seafloor. This method dampens the vertical and rotational motions of the platform, but allows for horizontal movements. Tendons are typically steel tubes with dimensions of 2-3 foot in diameter with up to 3 inches of wall thickness, and lengths which depend on the water depth. Because of the excessive loads from wave, wind and current actions, tubular tendon components have to be manufactured by special technique with high cost materials such as titanium.

The two existing mooring systems fail to completely limit the movements of a floating platform and do so in a cost-effective manner. Accordingly, there is a present need for simple and inexpensive method for effectively anchoring a floating platform to the seabed. The present invention uses tendons which may be made from one or more wire cables or chains to tether the columns of a platform to the seabed. Each of the tendons are tensioned between the column and the anchor to limit motions of the platform in all directions.

DETAILED DESCRIPTION OF THE INVENTION

All illustrations of the drawings are for the purpose of describing selected versions of the present invention and are not intended to limit the scope of the present invention.

Figure 1:
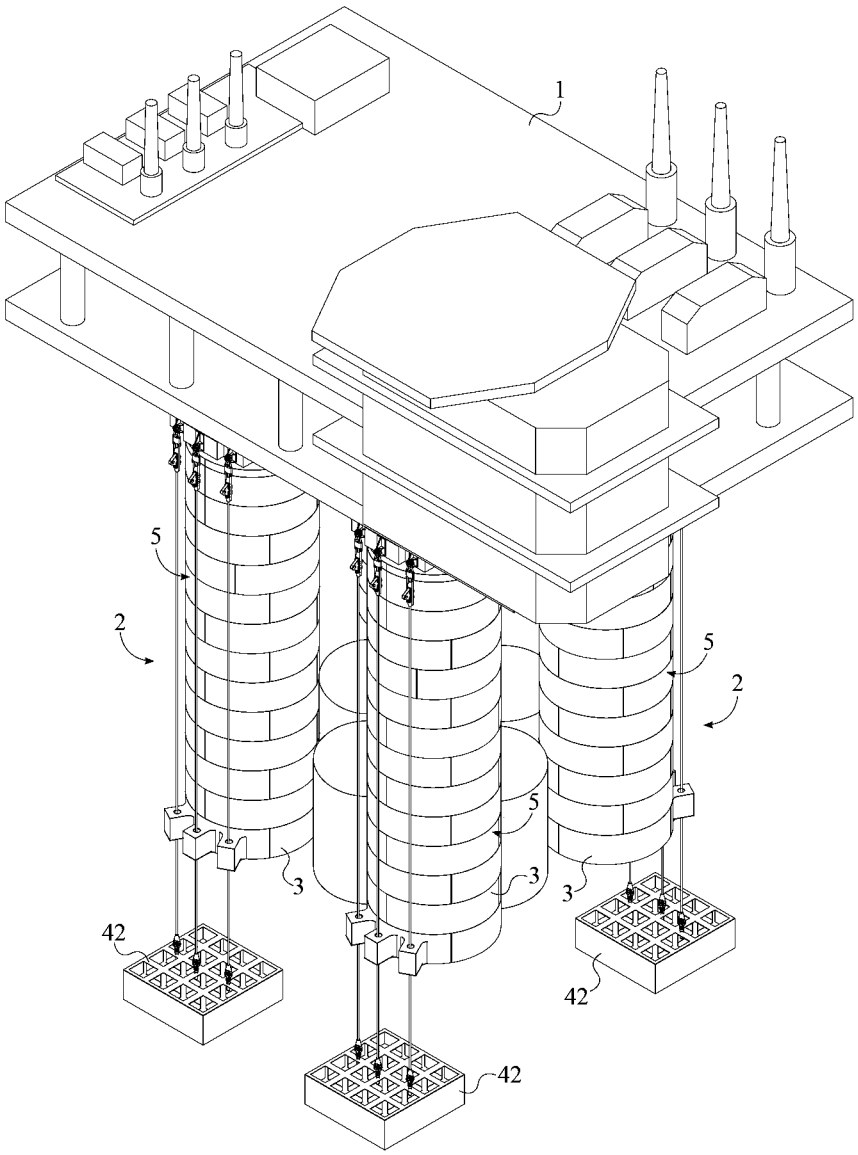
FIG. 1 is a perspective view of the present invention.
Figure 2:
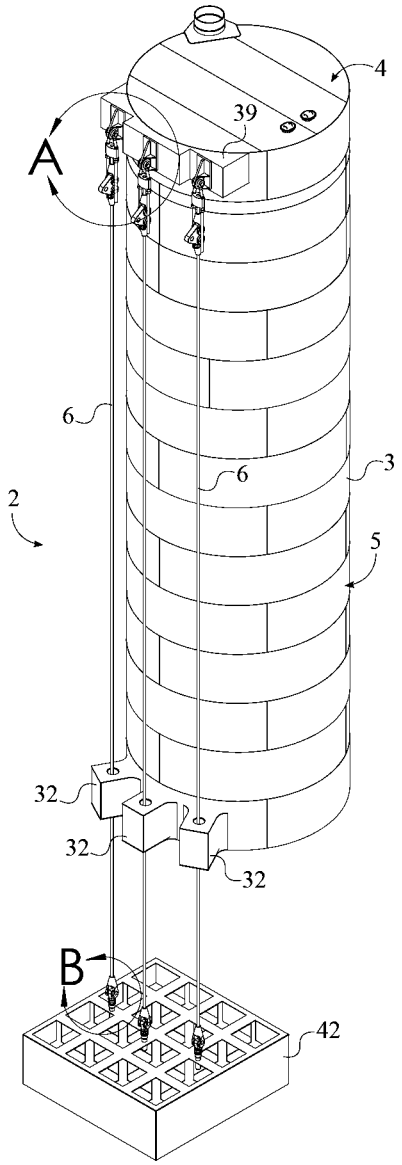
FIG. 2 is a perspective view of the first embodiment of the present invention, wherein the column coupler of the first embodiment is mounted to the lateral portion of the column.
Figure 3:
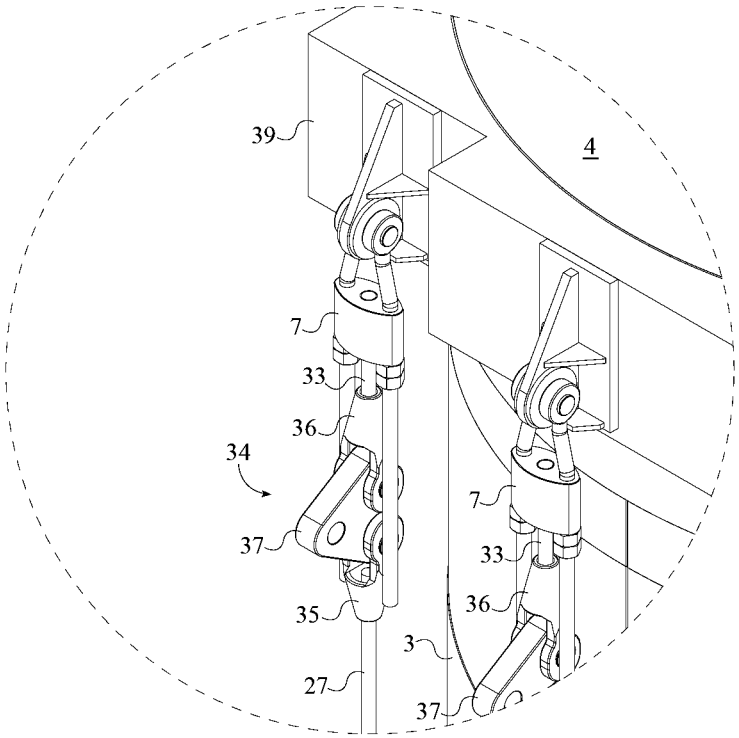
FIG. 3 is a detailed view of the first embodiment of the column coupler and the tendon joint taken about the circle A in FIG. 2.

With reference to FIGS. 1-3, the present invention is a tension-leg platform anchoring system which is used to anchor one or more column of a floating platform to the seabed of a large body of water. The present invention comprises a topside 1 and a plurality of anchored floating supports 2. The topside 1 is situated on top of each of the plurality of anchored floating supports 2 and provides a deck for supporting workers, equipment, and utilities needed for a specific job. Together, the topside 1 and the plurality of anchored floating supports 2 form a platform which may be deployed offshore to accomplish a certain mission. Each of the plurality of anchored floating supports 2 comprises a column 3, at least one mooring assembly 6, and an anchor 42. A first base 4 of the column 3 is mounted normal to the topside 1. The column 3 is used to provide enough of a buoyant force to keep the topside 1 above a body of water.

Figure 4:
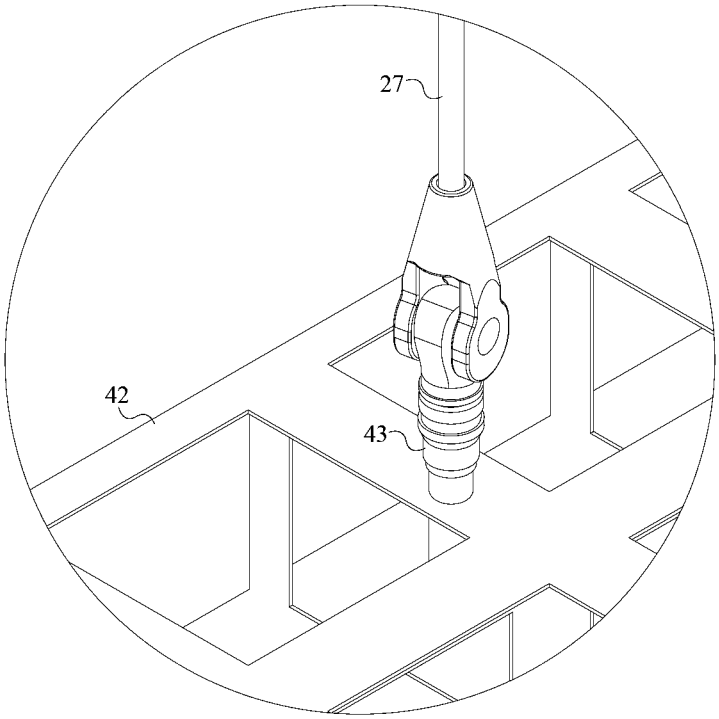
FIG. 4 is a detailed view of the anchor coupler taken about the circle B in FIG. 2.

The mooring assembly 6 is used to secure the column 3 to the seabed. The mooring assembly 6 comprises a column coupler 7, a first tendon 27, and an anchor coupler 43. The column coupler 7 is mounted to the column 3 and is used to connect the column 3 to the rest of the mooring assembly 6. As seen in FIG. 4, the anchor coupler 43 is tethered to the column coupler 7 by the first tendon 27. The first tendon 27 is positioned adjacent and along a lateral portion 5 of the column 3 and can be, but is not limited to, a single wire cable, a plurality of wire cables, or a chain. The anchor 42 is attached adjacent to the anchor coupler 43, opposite to the first tendon 27. The anchor 42 is used to limit how much the column 3 is able to move. In the preferred embodiment of the present invention, the anchor 42 is a gravity anchor, however a suction pile, a driven pile, or any other anchoring means may be used. When the present invention is being installed, after the first tendon 27 is attached to the anchor 42 via the anchor coupler 43, the first tendon 27 may be tensioned to provide stability to the column 3 and ultimately the topside 1.

Figure 13:
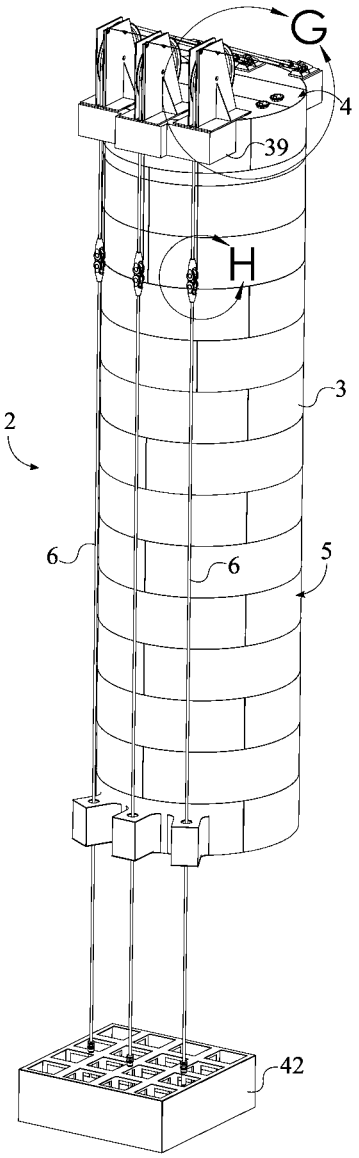
FIG. 13 is a perspective view of the second embodiment of the present invention, wherein the column coupler of the second embodiment is mounted onto the first base of the column.

The present invention may be generally configured in one of two ways. In a first embodiment of the present invention, shown in FIG. 2, the column coupler 7 is mounted to the lateral portion 5 of the column 3. In this embodiment, the column coupler 7 may be mounted adjacent to the first base 4, opposite the first base 4, or anywhere along the lateral portion 5. This is the preferred mounting method for the present invention; however, in a second embodiment of the present invention, the column coupler 7 is mounted onto the first base 4 of the column 3. This is shown in FIG. 13. These two different embodiments can require unique arrangements for the components of the mooring assembly 6, but may also share some common aspects.

In both the first embodiment of present invention and the second embodiment of the present invention, the mooring assembly 6 further comprises a bell mouth 32. The bell mouth 32, shown in FIG. 2, is used receive lateral restoring forces from the first tendon 27, when the column 3 moves. This helps to stabilize the motion of platform. The bell mouth 32 is connected adjacent to the lateral portion 5 of the column 3 and is positioned offset from the column coupler 7 along the column 3. The first tendon 27 traverses through the bell mouth 32 such that if the column 3 shifts relative to the first tendon 27, the bell mouth 32 can help to counteract the movement of the column 3. In some embodiments of the present invention, a bell mouth 32 is not needed.

In both the first embodiment of the present invention and the second embodiment of the present invention, the mooring assembly 6 can further comprise a second tendon 33 and a tendon joint 34. In reference to FIG. 3, the tendon joint 34 comprises a first socket 35, a second socket 36, and a tendon link 37. In the preferred embodiment of the tendon joint 34, the first socket 35 and the second socket 36 are Spelter sockets. The first socket 35 is tethered to the anchor coupler 43 by the first tendon 27 and the second socket 36 is tethered to the column coupler 7 by the second tendon 33. The first socket 35 is engaged to the second socket 36 through the tendon link 37. This arrangement allows the first tendon 27 and the second tendon 33 to be detached when the platform is being moved. Furthermore, this arrangement allows for the first tendon 27 to be interchangeable with tendons of differing lengths to accommodate for the depth at which the platform is situated above the seabed. Using a second tendon 33 to tether the first tendon 27 to the column 3 makes the process of installation much simpler than it would otherwise be for directly attaching the first tendon 27 to the column coupler 7. An adjustment cable may be attached to the tendon link 37 and tensioned to provide a method for reducing the tension in first tendon 27 and the second tendon 33 while adjusting the length of the column coupler 7 or replacing the second tendon 33 to a tendon of a different length.

In the first embodiment of the present invention, a number of different types of column couplers 7 may be used. In a first embodiment of the column coupler 7, the column coupler 7 is a bridge socket that can be adjusted in length to accommodate for an uneven seabed or the settling of the anchor 42. This is seen in FIG. 3. The length of the bridge socket may also be adjusted to tension the first tendon 27 and the second tendon 33. Furthermore, adjusting the length of the open bridge socket can be done to accommodate for a second tendon 33 which is otherwise too short for the desired location of the platform. In the preferred embodiment of the present invention, this is done through the use of locking nuts; however, in alternative embodiments, other methods may be used. The first embodiment of the column coupler 7 is versatile enough that it is also suitable for the second embodiment of the present invention, wherein the column coupler 7 is connected to the lateral portion 5 of the column 3.

Figure 5:
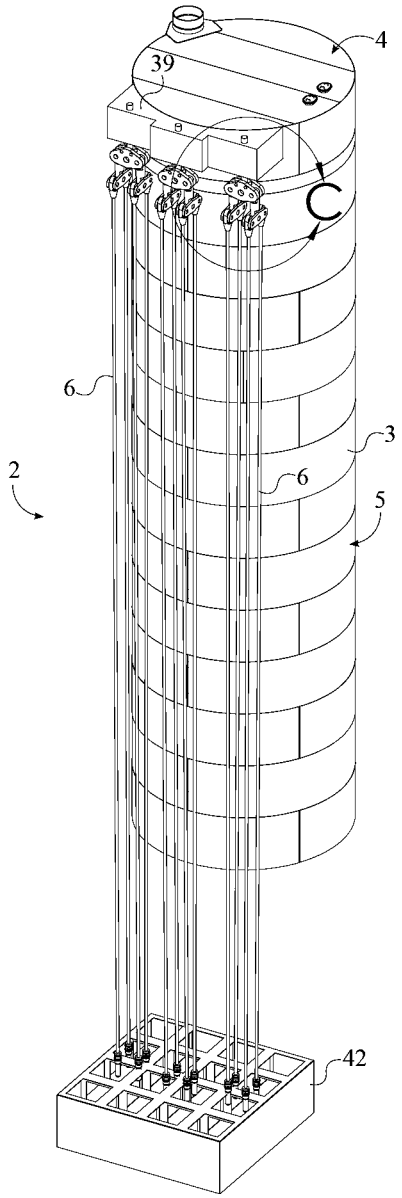
FIG. 5 is a perspective view of the first embodiment of the present invention, wherein the second embodiment of the column coupler is used.
Figure 6:
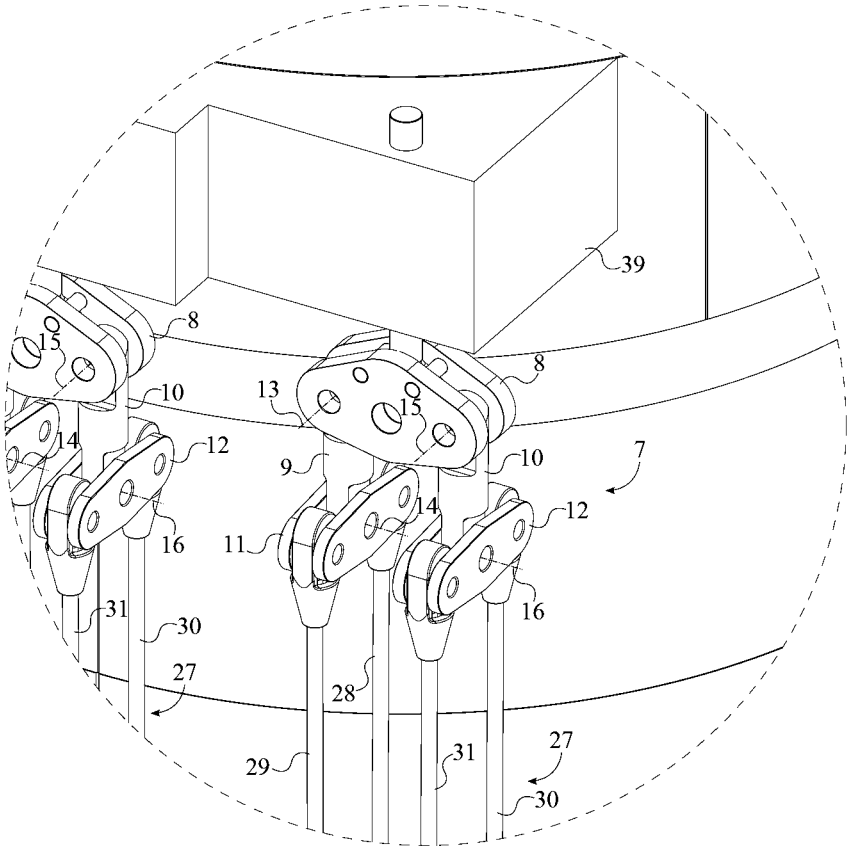
FIG. 6 is a detailed view of the second embodiment of the column coupler taken about the circle C in FIG. 5.
Figure 7A:
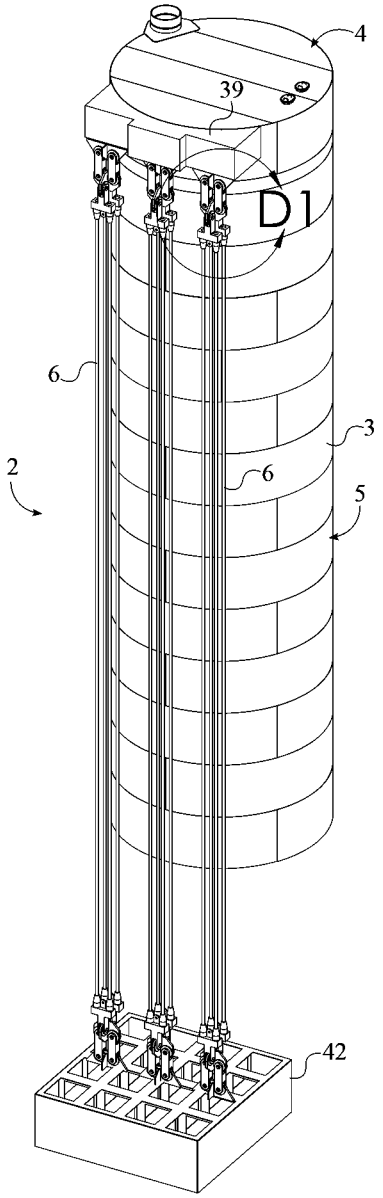
FIG. 7A is a perspective view of the first embodiment of the present invention, wherein the third embodiment of the column coupler is used.
Figure 7B:
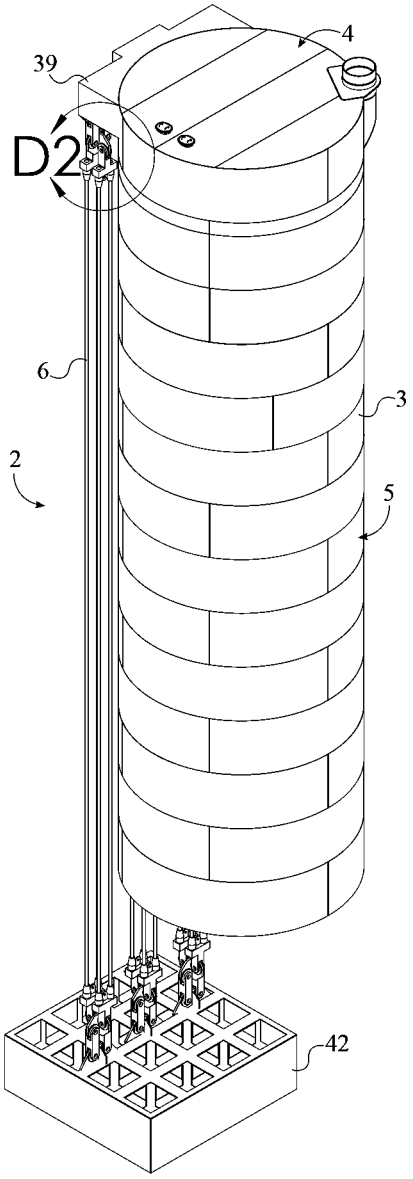
FIG. 7B is a rear perspective view of the first embodiment of the present invention, wherein the third embodiment of the column coupler is used.
Figure 8A:
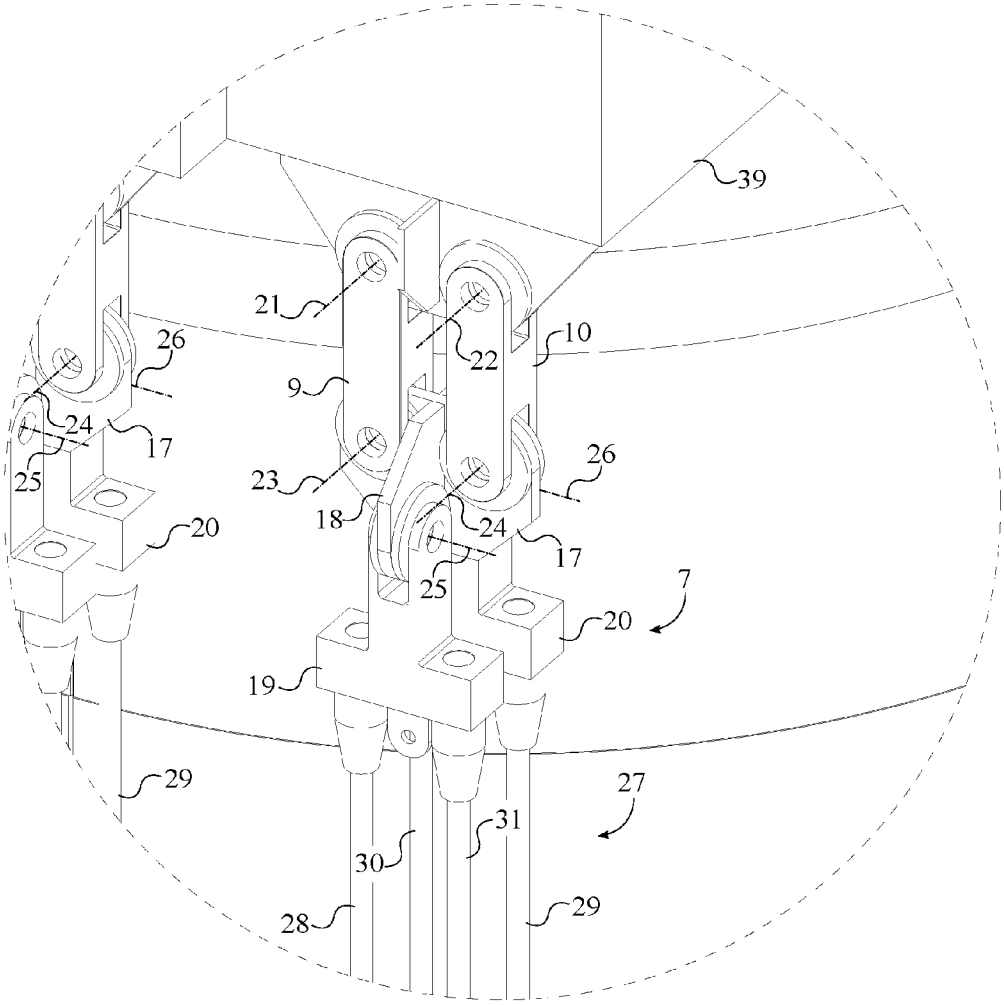
FIG. 8A is a detailed view of the third embodiment of the column coupler taken about the circle D1 in FIG. 7A.
Figure 8B:
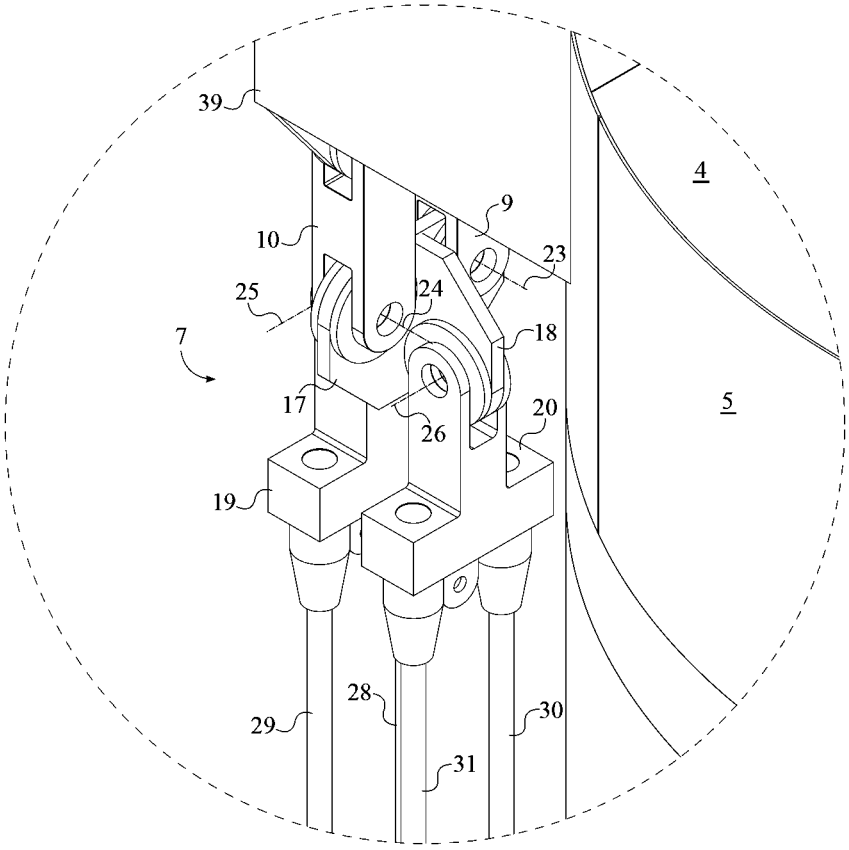
FIG. 8B is a detailed view of the third embodiment of the column coupler taken about the circle D2 in FIG. 7B.

In a second embodiment of the column coupler 7, the column coupler 7 comprises a mounting bracket 8, a first pivot link 9, a second pivot link 10, a first rocker bracket 11, and a second rocker bracket 12. The mooring assembly 6 further comprises a protruding mount 39. In reference to FIGS. 5-6, the protruding mount 39 is connected adjacent to the lateral portion 5, adjacent to the first base 4. The protruding mount 39 is used to provide clearance between the first tendon 27 and the lateral portion 5 of the column 3. The mounting bracket 8 is suspended from the protruding mount 39, adjacent to the lateral portion 5. The mounting bracket 8 acts as a base for the rest of the column coupler 7 to extend from. The first pivot link 9 and the second pivot link 10 are each hingedly connected to the mounting bracket 8. The first pivot link 9 and the second pivot link 10 are positioned opposite to each other along the mounting bracket 8. The first pivot link 9 and the second pivot link 10 are able to rotate about the mounting bracket 8 to adjust to movements of the column 3 or the anchor 42. The first rocker bracket 11 is hingedly connected to the first pivot link 9, opposite to the mounting bracket 8. The second rocker bracket 12 is hingedly connected to the second pivot link 10, opposite to the mounting bracket 8. Like the first pivot link 9 and the second pivot link 10, the first rocker bracket 11 and the second rocker bracket 12 are able to rotate to account for movements of the column 3. The first pivot link 9 and the second pivot link 10 are used to stabilize the first tendon 27 in the direction along the lateral portion 5 of the column 3, while the first rocker bracket 11 and the second rocker bracket 12 are used to stabilize the first tendon 27 for movements either towards or away from the lateral portion 5 of the column 3.

The second embodiment of the column coupler 7 is arranged in a specific manner to dampen the movements of the column 3 relative to the anchor 42. In this arrangement, a rotation axis 13 of the hinged connection between the first pivot link 9 and the mounting bracket 8 is oriented perpendicular to a rotation axis 14 of the hinged connection between the first pivot link 9 and the first rocker bracket 11. A rotation axis 15 of the hinged connection between the second pivot link 10 and the mounting bracket 8 is oriented perpendicular to a rotation axis 16 of the hinged connection between the second pivot link 10 and the second rocker bracket 12. The connection between the first pivot bar and the mounting bracket 8 and the connection between the second pivot bar and the mounting bracket 8 are both used to account for movements in a direction along the lateral portion 5 of the column 3. The connection between the first pivot link 9 and the first rocker bracket 11 and the connection between the second pivot link 10 and the second rocker bracket 12 are both used to account for movements either towards or away from the column 3. The rotation axis 13 of the hinged connection between the first pivot link 9 and the mounting bracket 8 is oriented parallel to the rotation axis 15 of the hinged connection between the second pivot link 10 and the mounting bracket 8. Overall, this arrangement allows for rotational control of the first tendon 27.

For the second embodiment of the column coupler 7 to work correctly, it is necessary that the first tendon 27 comprises a first wire cable 28 and a second wire cable 29, a third wire cable 30 and a fourth wire cable 31. The first wire cable 28 and the second wire cable 29 are each hingedly attached to the first rocker bracket 11. The first wire cable 28 and the second wire cable 29 are positioned opposite to each other along the first rocker bracket 11. The movements of the first wire cable 28 and the second wire cable 29 are dependent upon each other and account for half of the first tendon 27. The third wire cable 30 and the fourth wire cable 31 are each hingedly attached to the second rocker bracket 12. The third wire cable 30 and the fourth wire cable 31 are positioned opposite to each other along the second rocker bracket 12. The movements of the third wire cable 30 and the fourth wire cable 31 are dependent upon each other and account for half of the first tendon 27. The first wire cable 28 and the second wire cable 29, however, move independently from the third wire cable 30 and the fourth wire cable 31. This arrangement allows for the tension in the first wire cable 28, the second wire cable 29, the third wire cable 30, and the fourth wire cable 31 to equalize.

In a third embodiment of the column coupler 7, the column coupler 7 comprises a first pivot link 9, a second pivot link 10, a first stabilizing bracket 17, a second stabilizing bracket 18, a first swinging bracket 19, and a second swinging bracket 20. In reference to FIGS. 7A, 7B, 8A, and 8B, the first pivot link 9 is hingedly mounted to the protruding mount 39 and the second pivot link 10 is hingedly mounted to the protruding mount 39, adjacent to the first pivot link 9. The first pivot link 9 and the second pivot link 10 help to stabilize the column 3 in the event that the anchor 42 settles on the seabed or if the column 3 moves. The first stabilizing bracket 17 is hingedly connected to the first pivot link 9, opposite to the protruding mount 39. The first stabilizing bracket 17 is also hingedly connected to the second pivot link 10, opposite to the protruding mount 39. The second stabilizing bracket 18 is connected perpendicular to the first stabilizing bracket 17, in between the first pivot link 9 and the second pivot link 10. Together, the first stabilizing bracket 17 and the second stabilizing bracket 18 form a joint about which the column 3 and the first tendon 27 can move relative to each other. The first swinging bracket 19 is hingedly connected to the second stabilizing bracket 18, adjacent to the first stabilizing bracket 17. The second swinging bracket 20 is hingedly connected to the second stabilizing bracket 18, adjacent to the first stabilizing bracket 17 and opposite to the first swinging bracket 19. The first swinging bracket 19 and the second swinging bracket 20 are each used to stabilize the movements of the column 3 in a direction perpendicular to that of the first pivot link 9 and the second pivot link 10.

Similar to the second embodiment of the column coupler 7, the third embodiment of the column coupler 7 is arranged in a specific manner to dampen the movements of the column 3. In this arrangement, a rotation axis 21 of the hinged connection between the first pivot link 9 and the protruding mount 39 is oriented parallel to a rotation axis 22 of the hinged connection between the second pivot link 10 and the protruding mount 39. The rotation axis 21 of the hinged connection between the first pivot link 9 and the protruding mount 39 is oriented parallel to a rotation axis 23 of the hinged connection between the first pivot link 9 and the first stabilizing bracket 17. The rotation axis 23 of the hinged connection between the first pivot link 9 and the first stabilizing bracket 17 is oriented parallel to a rotation axis 24 of the hinged connection between the second pivot link 10 and the first stabilizing bracket 17. The connection between the first pivot link 9 and the protruding mount 39 and the connection between the second pivot link 10 and the protruding mount 39 are both used to account for movements in a direction along the lateral portion 5 of the column 3. The rotation axis 23 of the hinged connection between the first pivot link 9 and the first stabilizing bracket 17 is oriented perpendicular to a rotation axis 25 of the hinged connection between the second stabilizing bracket 18 and the first swinging bracket 19. The rotation axis 25 of the hinged connection between the second stabilizing bracket 18 and the first swinging bracket 19 is oriented parallel to a rotation axis 26 of the hinged connection between the second stabilizing bracket 18 and the second swinging bracket 20. The connection between the first swinging bracket 19 and the second stabilizing bracket 18 and the connection between the second swinging bracket 20 and the second stabilizing bracket 18 are both used to account for movements either towards or away from the lateral portion 5 of the column 3. Overall, this arrangement allows for rotational control of the first tendon 27.

For the third embodiment of the column coupler 7 to work properly, it is necessary that the first tendon 27 comprises a first wire cable 28, a second wire cable 29, a third wire cable 30, and a fourth wire cable 31. The first wire cable 28 is attached adjacent to the first swinging bracket 19, opposite to the second stabilizing bracket 18. The second wire cable 29 is attached adjacent to the first swinging bracket 19, adjacent to the first wire cable 28. The movements of the first wire cable 28 and the second wire cable 29 are dependent upon each other and account for half of the first tendon 27. The third wire cable 30 is attached adjacent to the second swinging bracket 20, opposite to the second stabilizing bracket 18. The fourth wire cable 31 is attached adjacent to the second swinging bracket 20, adjacent to the third wire cable 30. The movements of the third wire cable 30 and the fourth wire cable 31 are dependent upon each other and account for half of the first tendon 27. The first wire cable 28 and the second wire cable 29, however, move independently from the third wire cable 30 and the fourth wire cable 31. This allows for better control of the positioning of the column 3 and results in a smaller response from the column 3 in the event that the anchor 42 settles itself on the seabed.

Figure 9:
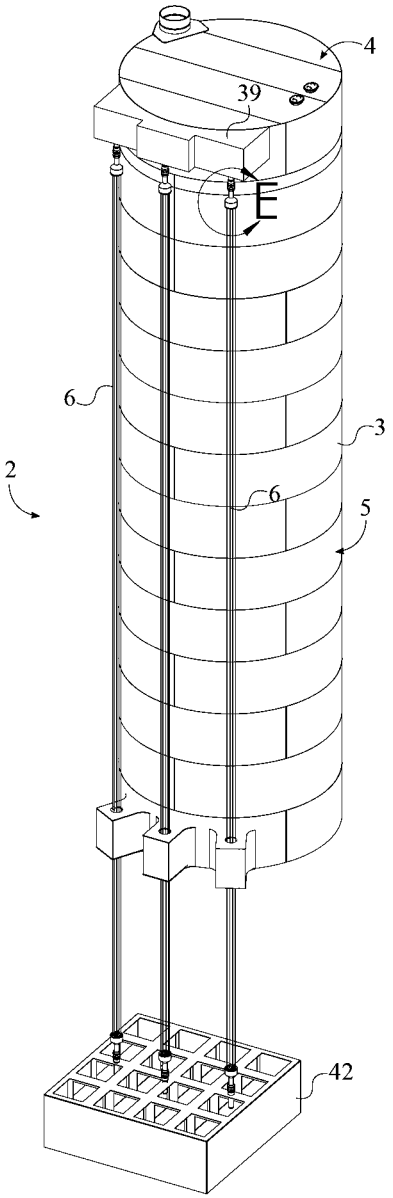
FIG. 9 is a perspective view of the first embodiment of the present invention, wherein the second embodiment of the first tendon is used.
Figure 10:
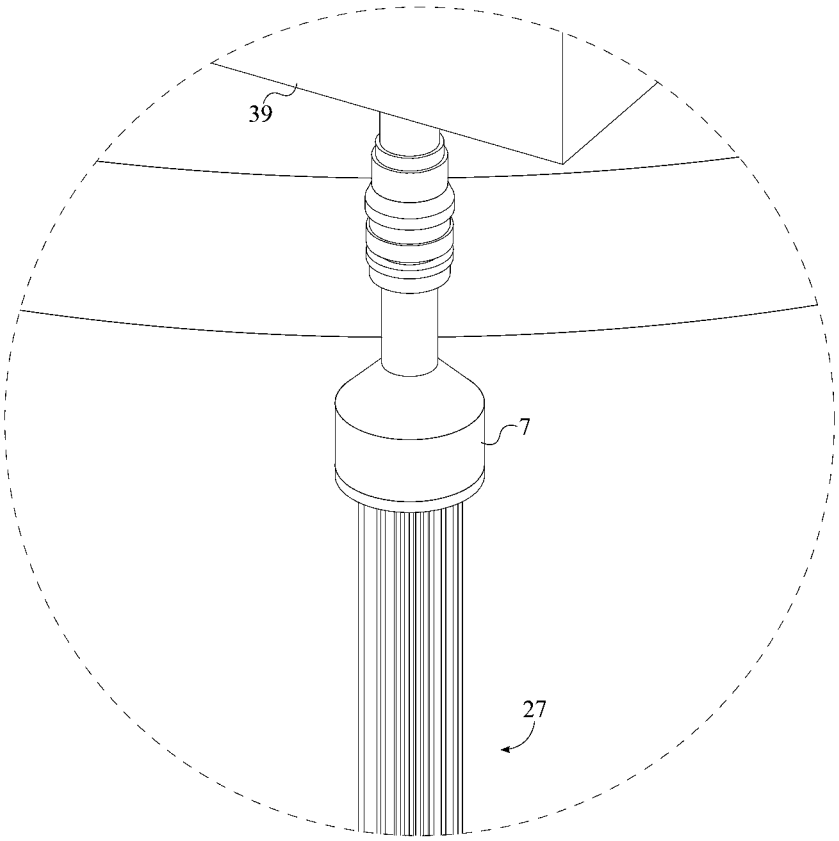
FIG. 10 is a detailed view of the second embodiment of the first tendon taken about the circle E in FIG. 9.
Figure 11:
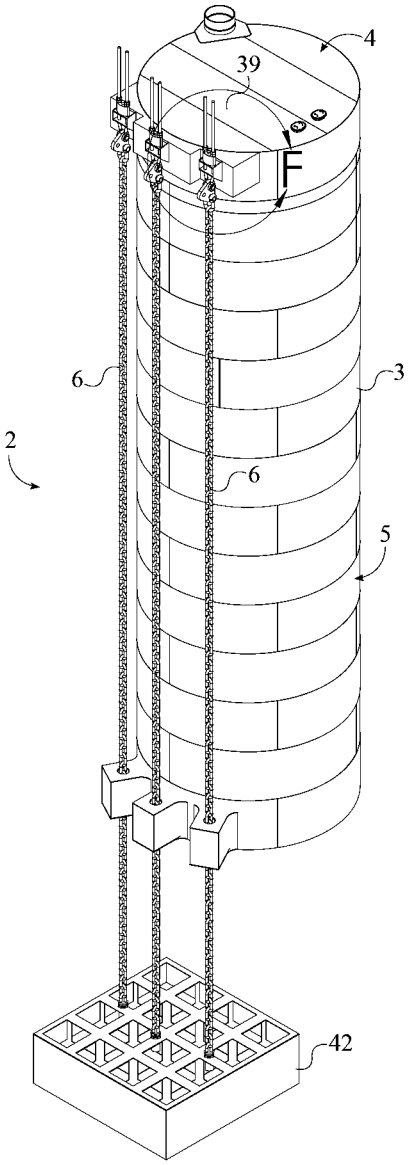
FIG. 11 is a perspective view of the first embodiment of the present invention, wherein the third embodiment of the first tendon is used.
Figure 12:
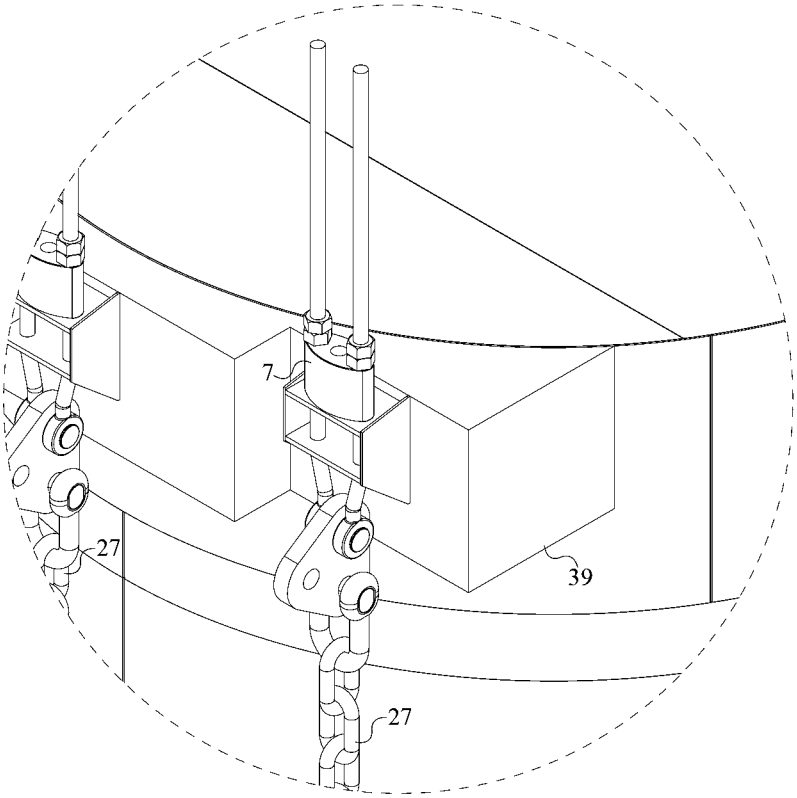
FIG. 12 is a detailed view of the third embodiment of the first tendon taken about the circle F in FIG. 11.

In the first embodiment of the present invention, a number of different embodiments for the first tendon 27 may be used. In a first embodiment of the first tendon 27, the first tendon 27 is a single tendon cable. This is shown in FIG. 2. This configuration is the simplest of the first tendon 27 embodiments and is used when the tendon joint 34 and the second tendon 33 are incorporated into the present invention. In this case, the second cable is also a single tendon cable. In a second embodiment of the first tendon 27, shown in FIG. 5 and FIGS. 9-10, the first tendon 27 is a plurality of wire cables. Specifically, in the second and third embodiments of the column coupler 7, the first tendon 27 comprises four wire cables; however, in alternative embodiments of the first tendon 27, the first tendon 27 may be any number of wire cables. In a third embodiment of the first tendon 27, the first tendon 27 is at least one chain. This is shown in FIGS. 11-12. In this embodiment of the first tendon 27, it is preferred that the first embodiment of the column coupler 7 is used to mount the first tendon 27 to the column 3.

Figure 14:
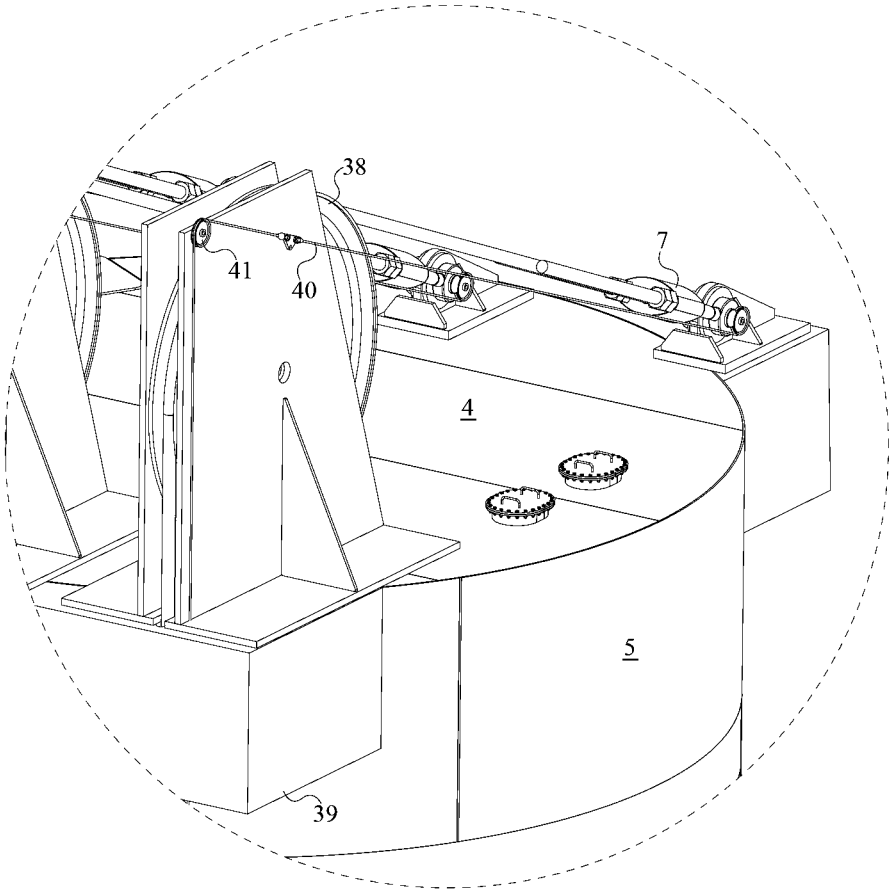
FIG. 14 is a detailed view of the column coupler, the sheave, and the pulley taken about the circle G in FIG. 13.
Figure 15:
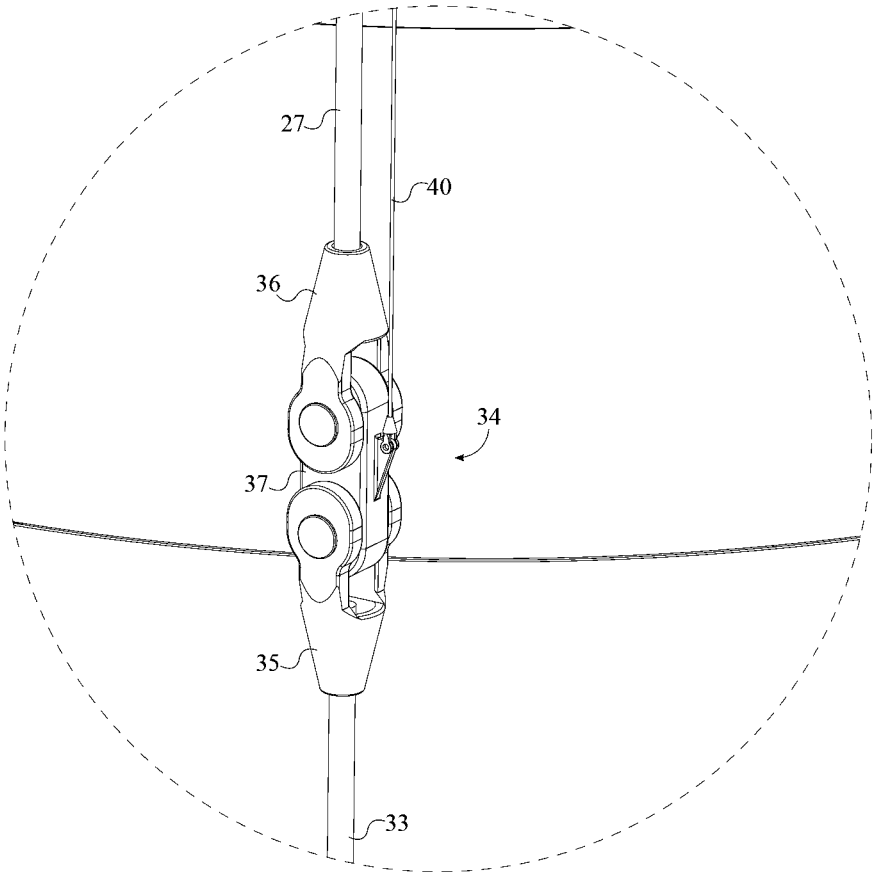
FIG. 15 is a detailed view of the tendon joint taken about the circle H in FIG. 14.

In the second embodiment of the present invention, shown in FIGS. 13-15, the column coupler 7 is mounted onto the top base of the column coupler 7. In this embodiment of the present invention, the first embodiments of the column coupler 7 and the first tendon 27 are used. Furthermore, the second embodiment of the present invention requires that the mooring assembly 6 further comprises the second tendon 33, the tendon joint 34, a sheave 38, and the protruding mount 39. Similar to many configurations for the first embodiment of the present invention, the protruding mount 39 is connected adjacent to the lateral portion 5, adjacent to the first base 4. However, in the second embodiment of the present invention, the protruding mount 39 and the column coupler 7 are positioned opposite of each other across the first base 4. The sheave 38 is rotatably mounted to the first base 4 and the protruding mount 39. The sheave 38 is used to direct the second tendon 33 over the first base 4 and along the lateral portion 5 of the column 3. The column coupler 7 is tethered to the tendon joint 34 by the second tendon 33. The second tendon 33 is tensionably engaged about the sheave 38. This arrangement allows for the second tendon 33 to be raised or lowered relative to the seabed along the sheave 38. The anchor coupler 43 is tethered to the tendon joint 34 by the first tendon 27 thus creating a complete tether between the column 3 and the seabed.

In the second embodiment of the present invention, the mooring assembly 6 further comprises a tendon adjustment cable 40 and a pulley 41. The pulley 41 is rotatably mounted to the first base 4, adjacent to the sheave 38. The pulley 41 is used to direct the tendon adjustment cable 40 in-between the column coupler 7 and the tendon link 37 without contacting the column 3. The column coupler 7 is tethered to the tendon joint 34 by the tendon adjustment cable 40. The tendon adjustment cable 40 is tensionably engaged about the pulley 41. This arrangement allows the tendon adjustment cable 40 to be used to raise or lower the second tendon 33. This is necessary during installation to prevent the first tendon 27 from dragging against the seabed while the platform is being moved into position. Furthermore, the tendon adjustment cable 40 may be used to relieve tension on the second tendon 33 so that the second tendon 33 may be replaced with a tendon of a different length.

Although the invention has been explained in relation to its preferred embodiment, it is to be understood that many other possible modifications and variations can be made without departing from the spirit and scope of the invention as hereinafter claimed.

What is claimed is:

1. A tension-leg platform anchoring system comprises:

a topside;

a plurality of anchored floating supports;

each of the plurality of anchored floating supports comprises a column, at least one mooring assembly, and an anchor;

the mooring assembly comprises a column coupler, a first tendon, and an anchor coupler;

a first base of the column being mounted normal to the topside;

the column coupler being mounted to the column;

the anchor coupler being tethered to the column coupler by the first tendon;

the first tendon being positioned adjacent and along a lateral portion of the column;

the anchor being attached adjacent to the anchor coupler, opposite to the first tendon;

the mooring assembly further comprises a second tendon, a tendon joint, a sheave and a protruding mount;

the protruding mount being connected adjacent to the lateral portion, adjacent to the first base;

the protruding mount and the column coupler being positioned opposite of each other across the first base;

the sheave being rotatably mounted onto the first base and the protruding mount;

the column coupler being tethered to the tendon joint by the second tendon;

the second tendon being tensionably engaged about the sheave;

the anchor coupler being tethered to the tendon joint by the first tendon;

the mooring assembly further comprises a tendon adjustment cable and a pulley;

the pulley being rotatably mounted to the first base, adjacent to the sheave;

the column coupler being tethered to the tendon joint by the tendon adjustment cable; and the tendon adjustment cable being tensionably engaged about the pulley.

2. The tension-leg platform anchoring system as claimed in claim 1, wherein the column coupler is mounted to the lateral portion of the column.

3. The tension-leg platform anchoring system as claimed in claim 1, wherein the column coupler is mounted onto the first base of the column.

4. The tension-leg platform anchoring system as claimed in claim 1 comprises:

the mooring assembly further comprises a bell mouth;

the bell mouth being connected adjacent to the lateral portion of the column;

the bell mouth being positioned offset from the column coupler along the column; and the first tendon traversing through the bell mouth.

5. The tension-leg platform anchoring system as claimed in claim 1 comprises:

the tendon joint comprises a first socket, a second socket, and a tendon link;

the first socket being tethered to the anchor coupler by the first tendon;

the second socket being tethered to the column coupler by the second tendon; and the first socket being engaged to the second socket through the tendon link.

6. The tension-leg platform anchoring system as claimed in claim 1, wherein the column coupler is a bridge socket.

7. The tension-leg platform anchoring system as claimed in claim 1, wherein the first tendon is at least one chain.

* * * * *